United States Patent [19]

Wolfram

[11] Patent Number: 4,560,904

[45] Date of Patent: Dec. 24, 1985

[54] TRAVELING-WAVE TUBE WITH A PERIODIC PERMANENT-MAGNET FOCUSING SYSTEM

[75] Inventor: Roland Wolfram, Munich, Fed. Rep. of Germany

[73] Assignee: Siemens Aktiengesellschaft, Berlin and Munich, Fed. Rep. of Germany

[21] Appl. No.: 551,523

[22] Filed: Nov. 14, 1983

[30] Foreign Application Priority Data

Dec. 30, 1982 [DE] Fed. Rep. of Germany ..... 3248693

[51] Int. Cl.[4] ..... H01J 25/34

[52] U.S. Cl. ..... 315/3.5; 315/5.35; 315/3.6

[58] Field of Search ..... 315/5.35, 3.5, 3.6, 315/39.3

[56] References Cited

U.S. PATENT DOCUMENTS

| | | | |
|---|---|---|---|
| 3,324,439 | 6/1967 | Winslow | 315/3.5 |
| 3,329,915 | 7/1967 | Meyerer | 315/5.35 X |
| 3,617,802 | 11/1971 | Manoly | 315/3.5 |
| 3,885,192 | 5/1975 | Esterson et al. | 315/3.5 |
| 4,041,349 | 8/1977 | Davis | 315/3.5 |
| 4,072,877 | 2/1978 | Davis | 315/3.5 |
| 4,137,482 | 1/1979 | Caryotakis et al. | 315/3.5 |
| 4,399,389 | 8/1983 | Fleury et al. | 315/5.35 |

FOREIGN PATENT DOCUMENTS

| | | | |
|---|---|---|---|
| 1491529 | 7/1971 | Fed. Rep. of Germany | 315/3.5 |
| 2556464 | 12/1975 | Fed. Rep. of Germany | 315/5.35 |

*Primary Examiner*—Saxfield Chatmon

*Attorney, Agent, or Firm*—John Francis Moran

[57] ABSTRACT

This invention refers to a traveling-wave tube with cylindrical evacuated sheath 3, which is surrounded by a permanent-magnet system including pole shoes 1 and magnet rings 2 inserted between the pole shoes, while pole shoes 1 inserted in evacuated sheath 3 and the parts of them that surround beam axis 7 are designed as small tubes 4. Every second pole shoe is coupled as an active pole shoe 1 to magnet ring 2, and pole shoes 5 that are inserted between are connected with evacuated sheath 3. This traveling-wave tube is capable of focusing with greater efficiency and at higher frequencies than existing systems. This invention also provides that active pole shoes 1, which are coupled to magnet rings 2, are made of magnetic metal and that at least front ends 8 of small tubes 4 are made of non-magnetic metal. In addition, pole shoes 5 inserted between are made of non-magnetic and their small tubes 6 of magnetic metal. According to this invention, the focusing system is used with high performance traveling-wave tubes.

6 Claims, 5 Drawing Figures

TRAVELING-WAVE TUBE WITH A PERIODIC PERMANENT-MAGNET FOCUSING SYSTEM

BACKGROUND OF THE INVENTION

The invention is related to a traveling-wave tube which has a cylindrical evacuated sheath which is surrounded by a permanent-magnet system having poles shoes with magnetic rings inserted between the pole shoes which are axially arranged with alternating opposite polarization. In addition, the pole shoes inserted in the evacuated sheath and the parts of them that surround the beam axis are designed as small tubes, with every second pole shoe coupled as an active pole shoe to the magnetic rings, and the pole shoes that are inserted between are connected with the evacuated sheath.

The focusing of an electron beam from a traveling-wave tube by means of a periodic permanent-magnet focusing system, mounted externally on the evacuated sheath of the tube, is a familiar process. Focusing systems of this kind usually consist of permanent magnet rings and pole shoes of ferromagnetic material inserted between them.

A pole shoe arrangement of this type which serves simultaneously as an evacuated sheath is disclosed in German Patent DE-AS No. 14 91 529. Simultaneous mechanical processing of all the internal borings of the pole shoes allows the pole shoes to be oriented exactly to the axis. In addition, the magnet rings are centered on the inner diameter.

In traveling-wave tubes with a very high output, a sturdy coupled cavity line is used with a large outer diameter. The field strength of a superimposed ring magnet system would therefore be too small to be able to focus electron beams with a high perveance, such as are needed for a high output. Therefore, the pole shoes are introduced into the tube by constructing the conducting discs as pole shoes ("integrated pole shoes"). Particularly suitable for this purpose is the coupled-cavity wiring with "caps" (i.e., the parts of the conducting discs that are close to the axis and have the shape of small tubes). FIG. 1 shows schematically a conventional system of this kind, and FIG. 2 shows graphically the magnetic field generated by such a system. There are specific reasons why every second conducting disc consists of an active pole shoe connected to the magnets. First, this achieves a compensation for the magnetic asymmetry caused by windows 10. Second, it produces a suppression of the ripple of the first order by means of the harmonics of the magnetic field. The ripple of the first order is either almost or completely suppressed by a field configuration of the type shown in FIG. 2. Through measurement of the delay line the ratio h/l (gap/cell length) is obtained, by means of which the magnetic design parameters can be determined.

The thickness t of the conducting discs sould be as small as possible, otherwise the coupling resistance in the area of the beam will be reduced by an unfavorable shift in the electric field. The limitation of this magnetic system is therefore the iron stress $B_1$ on the disc, which reaches its highest value at Point B. It is essential for several reasons to prevent the iron stress from reaching the point of magnetic saturation, in particular to eliminate impermissible production spreads. Since the measurements of the magnetic system also determine $B_1/B_{eff}$, the limitation on the iron stress has the effect of determining a limit for the effective fluid strength $B_{eff}$. From the equilibrium relationship $$\frac{\sqrt{U_o}}{\bar{\gamma}} \cdot \sqrt{P_o/(1 - K_{eff})} \simeq \frac{B_{eff}}{830}$$

and the relationship for the frequency $$\frac{\sqrt{U_O}}{\bar{\gamma}} \simeq \frac{233 \cdot f}{\gamma^a}$$

it follows that the perveance of the beam, $P_o$ and the frequency, f have an upward limit. (Units: $10^{-4}$T, V, A, cm, GHz. $U_o$ is the beam voltage, $\bar{\gamma}$ is the middle radius, $\gamma a$ is the phase parameter and $K_{eff}$ is the cathode field parameter). According to the state of the art, there are travelling-wave tubes of this kind with (approximately) $P_o = 2 \cdot 10^{-6}$ A/V$^{3/2}$ for f=9 to 10 GHz. for conventional magnetic systems of this kind, known for example from U.S. Pat. No. 3,324,339 and shown in FIG. 1, the parts of the conducting discs that are close to the axis are designed as small tubes and consists of magnetic iron.

SUMMARY OF THE INVENTION

The object of the invention is to make possible focusing of an electron beam from a traveling-wave tube for higher outputs and frequencies.

In general, the invention features a traveling-wave tube with cylindrical evacuated sheath, surrounded by a permanent-magnet system having pole shoes with magnet rings inserted between the pole shoes which are axially arranged with alternating opposite polarization while the pole shoes inserted in the evacuated sheath and parts of them that surround the beam axis are designed as small tube, every second pole shoe coupled as an active pole shoe to the magnet rings, and the pole shoes that are inserted between connected with the evacuated sheath, wherein the active pole shoes 1 coupled to the magnet rings 2 being made of magnetic metal, at least small tubes 4 front ends 8 being made of non-magnetic metal, and the pole shoes 5 are non-magnetic material inserted to associate with the tubes 6 made of magnetic metal.

In preferred embodiments of the travelling-wave tube the active pole shoes 1 are disc-shaped and the front ends 8 of the small tubes 4 extend to the lateral walls of the pole shoes; the small tubes 6 of the pole shoes 5 are made of magnetic metal and their front ends 9 of non-magnetic metal; the ratio of small tube length b of the part of the small tube 6 made of magnetic metal to the magnetic field period L measures 0.065 to 0.15; the magnetic metal of the pole shoes 1 in small tubes 6 of the pole shoes 5 is iron; and the non-magnetic metal of the small tube parts 8 of the active pole shoes 1, and the pole shoes 5 inserted between, as well as front end 9 of their tube 6 is copper.

The traveling-wave tube of the invention has the advantages that because of the separation made at the small tubes between the magnetic iron contours and the non-magnetic metal contours, the line measurement remains constant, while the iron stress of the disc is reduced. The result is that a higher magnetic field strength can be achieved and permitted in the area of the beam. This makes focusing possible for higher outputs and frequencies.

The most favorable situation occurs when the active pole shoe that is coupled to the magnets is merely a disc, and the intermediate pole shoe is merely a small tube. The iron stress at point B is then reduced by about 15%. Furthermore, by special dimensioning of the length b of the small tube, the ripple of the first order can be completely eliminated.

Depending in each case on the pole shoe diameter and the wall thickness t, the ratio of the length b of the small tube to the magnetic field period L should be in the range of 0.065 to 0.15.

Other features and advantages of the present invention will become apparent from the following detailed description, and from the claims.

For a full understanding of the present invention, reference should now be made to the following detailed description and to the accompanying drawings.

BRIEF DESCRIPTION OF THE DRAWINGS

The invention is further explained with the aid of the following figures in which the same elements in different figures are given the same reference numbers.

DETAILED DESCRIPTION

Throughout the drawings, magnetic material is designated by cross-hatching. A suitable magnetic material is magnetic iron.

Figure 1:
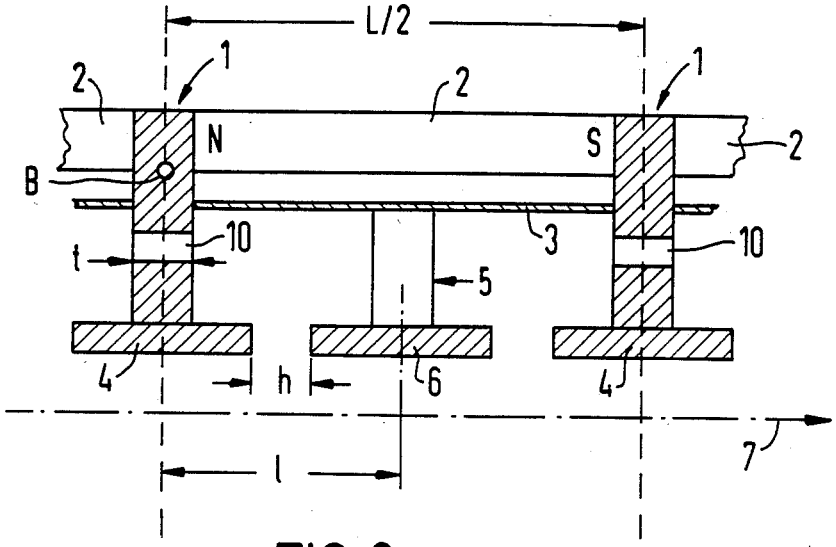
FIG. 1 shows a partial cross-sectional schematic view of a periodic, permanent-magnet focusing system of a conventional traveling-wave tube.
Figure 2:
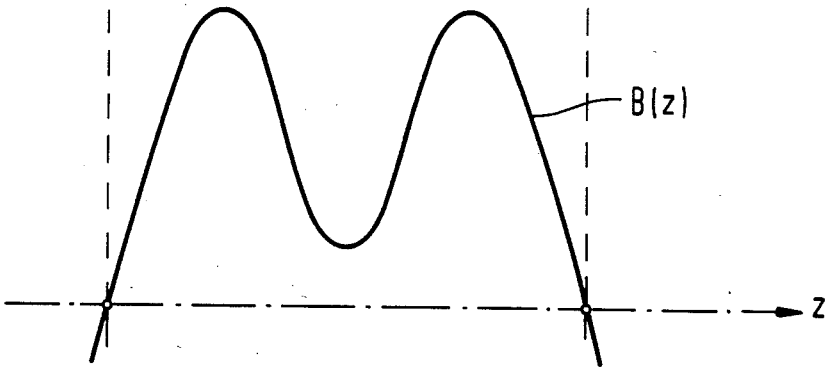
FIG. 2 shows schematically the magnet field generated by the system of FIG. 1.

The periodic permanent-magnet focusing system for a traveling-wave tube shown in FIG. 1, includes cylindrical evacuated sheath 3, which is surrounded by a permanent-magnet system consisting of pole shoes 1 and magnet rings 2 inserted between the pole shoes and axially arranged with alternating opposite polarization. Pole shoes 1, 5 are inserted in evacuated sheath 3 and the parts of them that surround beam axis 7 are designed as small tubes 4. Every second pole shoe is coupled as an active pole shoe 1 to the magnet rings 2. The pole shoes 5 that are inserted between are connected with the evacuation sheath 3 and are made, up to their small tubes 6 that surround beam axis 7, of a non-magnetic metal. In this arrangement, active pole shoes 1 as well as their small tubes 4, always consist of magnetic iron. The ratio of h/l (gap/cell length) is obtained by measuring the delay line. The thickness t of pole shoe discs 1 should be as small as possible. L/2 signifies half of the magnetic field period L. The highest value of the iron stress is achieved at the point indicated by letter B. FIG. 2 shows schematically the magnetic field B (z).

Figure 3:
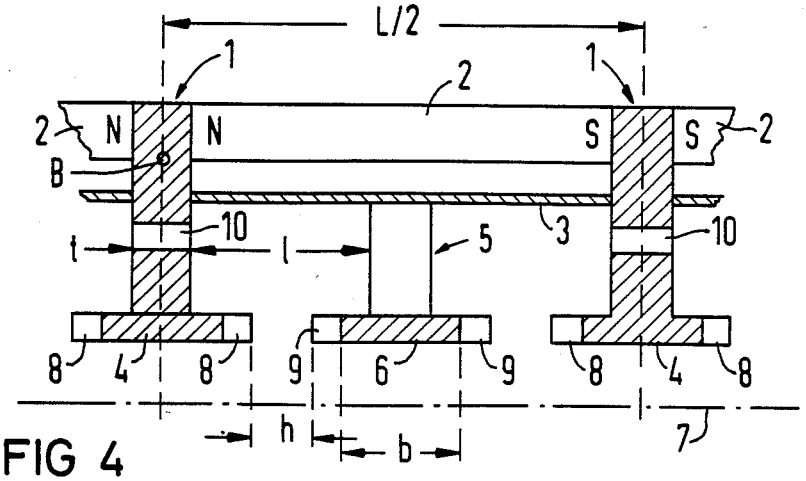
FIG. 3 shows a partial cross-sectional schematic view of a periodic, permanent-magnet focusing system for a traveling-wave tube, according to the invention.
Figure 4:
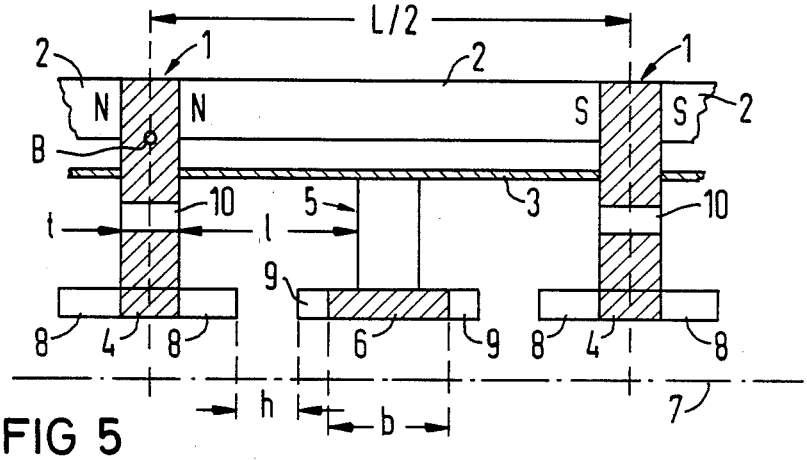
FIG. 4 shows a partial cross-sectional schematic view of another periodic, permanent-magnet focusing system for a traveling-wave tube, according to the invention.
Figure 5:
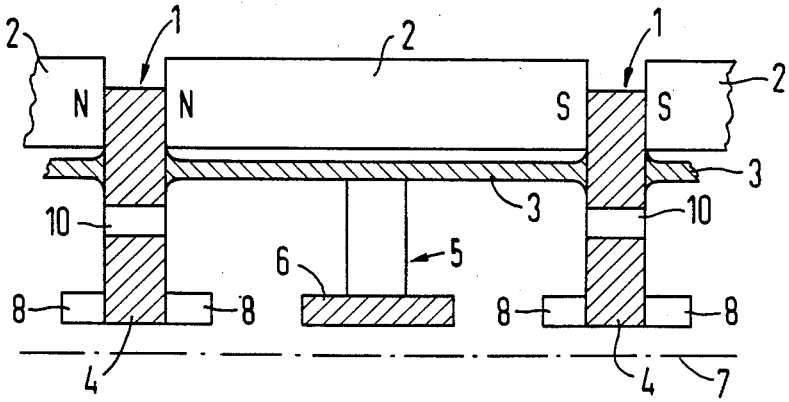
FIG. 5 shows a partial cross-sectional schematic view of another periodic, permanent-magnet focusing system for a traveling-wave tube, according to the invention.

On the other hand, the periodic permanent-magnetic focusing system shown in FIGS. 3, 4 and 5 include a cylindrical evacuated sheath 3 made of non-magnetic metal. The permanent-magnet system, which surrounds evacuated sheath 3, consists of active pole shoes 1 and magnet rings 2 inserted between the pole shoes and axially arranged with alternating opposite polarization. Active pole shoes 1 are inserted in evacuated sheath 3, and the parts of them that surround the beam axis 7 are designed as small tubes 4.

Pole shoes 5, which are connected with evacuated sheath 3 on the inside, are inserted between active pole shoes 1 coupled to magnetic rings 2. Active pole shoes 1 coupled to magnetic rings 2 are made of a magnetic metal, which is preferably magnetic iron. According to FIG. 3, small tubes 4 of these pole shoes 1 have front ends 8 consisting of non-magnetic metal. In FIG. 4, these non-magnetic metal parts 8 are larger than in FIG. 3 and extend further into the part of pole shoes 1 which form small tube 4. Like evacuated sheath 3, pole shoes 5 inserted between active pole shoes 1 are made of a non-magnetic metal, which is preferably copper. The inside of small tubes 6 of these pole shoes 5 is made of magnetic metal, preferably magnetic iron; and their front ends 9 are made of non-magnetic metal, preferably copper. In FIG. 5, small tubes 6 of pole shoes 5 are made entirely of magnetic metal, which is preferably magnetic iron. In FIGS. 3 and 4, the gap and cell length are again indicated with the letters h and l respectively. L/2 indicates half of the magnetic field period L, and B the point with the highest iron stress. The thickness t of the pole shoe disc 1 should again be as small as possible. Letter b indicates the tube length. In the figures, 10 refers to windows in pole shoes 1, 5.

This invention is not limited to the illustrated design examples. For instance, pole shoes may also be designed disc-shaped, i.e., tubes do not necessarily have to have lateral projections.

There has thus been shown and described a novel traveling-wave tube with a periodic permanent-magnet focusing system which fulfills all the object and advantages sought. Many changes, modifications, variations and other uses and application of the subject invention will, however, become apparent to those skilled in the art after considering this specification which discloses embodiments thereof. All such changes, modifications, variations and other uses and applications which do not depart from the spirit and scope of the invention are deemed to be covered by the invention which is limited only by the claims which follow.

What is claimed is:

1. A traveling-wave tube comprising: a cylindrical evacuated sheath, surrounded by a permanent-magnet system having pole shoes with magnet rings inserted between the pole shoes which are axially arranged with alternating opposite polarization while the pole shoes inserted in the evacuated sheath and the portion of them closest to the beam axis are shaped in the form of small tubes, every second pole shoe is coupled as an active pole shoe to the magnet rings, and the pole shoes that are located between the active pole shoes are attached to the evacuated sheath, said active pole shoes (1) are coupled to said magnet rings (2) and being made of magnetic metal at least end portions (8) located at the extremities of the said small tubes (4) being made of non-magnetic metal while the small tubes are made of magnetic metal, and said pole shoes (5) located between said tubes (6) being made of non-magnetic metal.

2. The traveling-wave tube according to claim 1, wherein said active pole shoes (1) are disc-shaped and said end portions (8) at the extremities of said small tubes (4) extend a predetermined distance beyond lateral walls of said pole shoes (1).

3. The traveling-wave tube according to claims 1 or 2, wherein said small tubes (6) of said pole shoes (5) are made of magnetic metal and having end portions (9) made of non-magnetic metal.

4. The traveling-wave tube according to claim 1, wherein the ratio of small tube length b of the part of said small tube (6) made of magnetic metal to the magnetic field period L measures 0.065 to 0.15.

5. The traveling-wave tube according to claim 1, wherein said magnetic metal of said pole shoes (1) and small tubes (6) of said pole shoes (5) is iron.

6. The traveling wave tube according to claim 1, wherein the non-magnetic metal of said small tube portions (8) of said active pole shoes (1), and said pole shoes (5) inserted between, as well as end portions of their tubes (6) is copper.

* * * * *